United States Patent [19]

Reibling

[11] 4,386,392

[45] May 31, 1983

[54] LIGHTING UNIT FOR PROVIDING INDIRECT LIGHT OF UNIFORM INTENSITY

[75] Inventor: Robert L. Reibling, Fort Thomas, Ky.

[73] Assignee: Whiteway Manufacturing Co., Cincinnati, Ohio

[21] Appl. No.: 207,319

[22] Filed: Nov. 17, 1980

[51] Int. Cl.[3] ..... F21V 7/09

[52] U.S. Cl. ..... 362/297; 362/301; 362/303; 362/346; 362/349; 363/350

[58] Field of Search ..... 362/297, 301, 303, 346, 362/349, 350

[56] References Cited

U.S. PATENT DOCUMENTS

| | | | |
|---|---|---|---|
| D. 61,209 | 7/1922 | Otte . | |
| D. 62,077 | 3/1923 | Zimmerman, Jr. . | |
| D. 80,952 | 5/1930 | Hoffman . | |
| D. 82,048 | 9/1930 | Neuwirth . | |
| D. 167,268 | 7/1952 | Lordo . | |
| D. 177,343 | 5/1956 | Mack et al. . | |
| D. 177,344 | 5/1956 | Mehr et al. . | |
| D. 207,789 | 5/1967 | Kimble . | |
| 1,302,492 | 5/1919 | Arenberg | 362/302 |
| 1,354,262 | 9/1920 | Mathieu | 362/355 |
| 1,457,630 | 6/1923 | Johnson | 362/290 |
| 1,499,083 | 6/1924 | Stephens | 362/301 |
| 1,558,270 | 10/1925 | Morrison . | |
| 1,583,216 | 5/1926 | Wompey | 362/302 |
| 1,591,287 | 7/1926 | Davis | 362/301 |
| 1,640,423 | 8/1927 | O'Neill . | |
| 1,869,823 | 8/1932 | Reader | 362/347 |
| 2,362,173 | 11/1944 | Swanson . | |
| 2,652,480 | 9/1953 | Duval | 362/140 |
| 2,836,708 | 5/1958 | Bobrick | 362/364 |
| 3,178,569 | 4/1965 | Martin . | |
| 3,749,906 | 7/1973 | Thiry | 240/46.01 |
| 3,950,638 | 5/1976 | Kent et al. | 240/41.1 |
| 3,997,776 | 12/1976 | Ruud | 240/2 SL |
| 4,001,575 | 1/1977 | Sullivan et al. | 240/81 LD |
| 4,041,305 | 8/1977 | Dean | 240/92 |
| 4,041,306 | 8/1977 | Compton et al. | 362/297 |
| 4,065,667 | 12/1977 | Ruud et al. | 362/297 |
| 4,237,528 | 12/1980 | Baldwin | 362/350 |
| 4,242,725 | 12/1980 | Douma et al. | 362/350 |

*Primary Examiner*—Irwin Gluck

*Attorney, Agent, or Firm*—Seidel, Gonda, Goldhammer & Panitch

[57] ABSTRACT

A lighting unit for indirect illumination of an area. The unit has first and second reflective surfaces contoured to direct reflected light rays from a source generally upward at predetermined angles for reflection by a surface above the lighting unit providing a symmetrical substantially uniform intensity of light over the area to be illuminated. The lighting unit may have cut-off baffles for redirecting the light rays away from nearby or adjacent vertical surfaces providing an asymmetrical substantially uniform intensity of light over the area to be illuminated.

10 Claims, 15 Drawing Figures

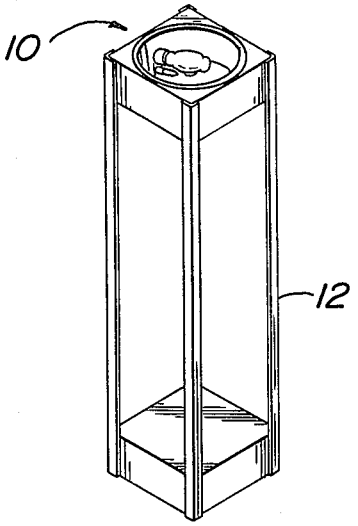
FIG. 1
FIG. 2
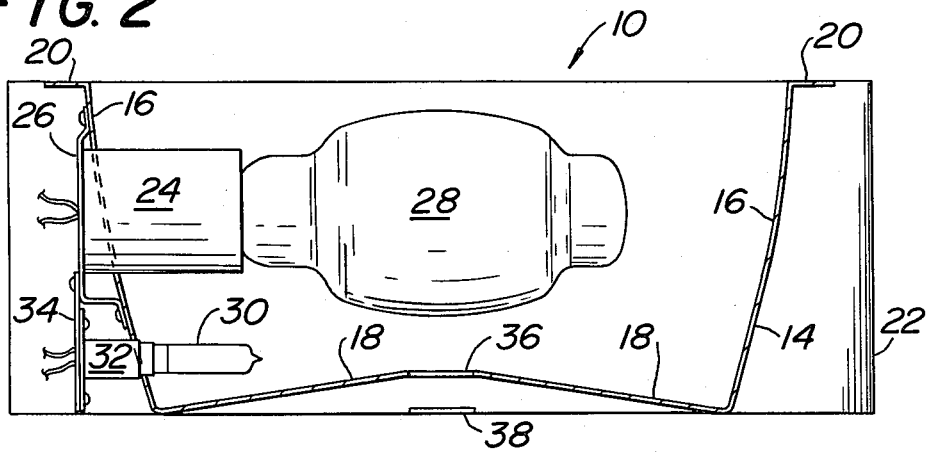
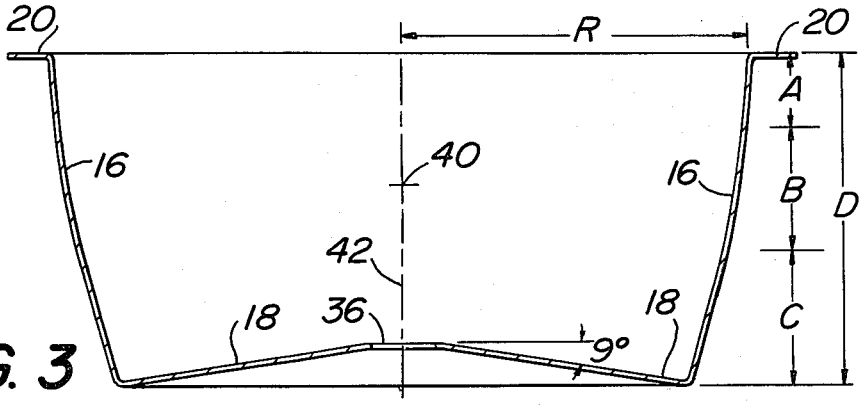
FIG. 3

44
50°
35°
20°
0°
20°
35°
50°
10
12
42
46
46
48
3'RAD
6'RAD
10'-6" RAD
0'

LIGHTING UNIT FOR PROVIDING INDIRECT LIGHT OF UNIFORM INTENSITY

BACKGROUND OF THE INVENTION

The present invention is directed to a lighting unit designed to provide a uniform illumination of a work area in a room by indirect or reflected light. More particularly, this invention is directed to a luminaire for providing indirect uniform illumination of a work area using a high intensity light source such as a discharge or metal halide lamp. This type of lighting unit is commonly referred to as a luminaire such as the one disclosed in U.S. Pat. No. 4,001,575. The luminaires now in use do not provide for a uniform intensity or uniform dispersion of light over the work area. The reflectors in the luminaires direct the downward going light rays from the lamp upward to be recombined with the direct light rays from the lamp directly above the luminaire creating a hot spot or more intense area of light. The more intense area of light directly above the lamp in turn provides for a more intense light pattern in an area closer to the luminaire at the level of the work area.

The present luminaires or lighting units usually provide a symmetrical lighting pattern covering a full 360° surrounding the luminaire. When placed adjacent to or near vertical surfaces, the lighting units tend to provide more intense light in their immediate vicinity due to the reflection from the nearby or adjacent vertical surface. The uncontrolled reflection from the vertical surface causes a non-uniform illumination at the level of the work area.

The ideal lighting unit or luminaire should generate a controlled light pattern with high light output. The lighting pattern should have a lower intensity directly above the lamp with a linearly increasing intensity moving outward from the area directly above the lighting unit. The lower light intensity directly above the lighting unit will eliminate the undesirable intense area. The reflector will redirect the light rays from the source so that maximum candle power can be achieved at certain predetermined angles within the desired pattern to provide for a uniform dispersion of the light rays to the ceiling or overhead surface and in turn to the work area.

The lighting unit of the present invention generates a 360° symmetric light pattern around the lighting unit. In order to prevent non-uniform light dispersion from nearby or adjacent vertical surfaces, differently shaped baffles have been added to the lighting unit to cut-off the reflected light from vertical surfaces such as walls and/or corners. These baffles redirect both the direct and reflected light rays upwardly and away from the vertial surfaces in predetermined limited patterns.

SUMMARY OF THE INVENTION

The present invention is directed to a lighting unit for indirect illumination of an area. This lighting unit has a light source centrally disposed within a bowl-shaped reflector which is open at the top and surrounds the light source on its sides and on the bottom. The reflector has first and second reflective surfaces which are contoured to direct the reflected light rays from the light source generally upward in a predetermined pattern. The reflective surfaces direct the reflected light rays away from a vertical axis extending through the focal center of the lighting unit at predetermined angles for reflection by a surface above and spaced from the lighting unit (e.g., a ceiling) at angles similar to the striking angles of the reflected light rays on this surface. This provides for a substantially uniform intensity of light over the area to be illuminated which area is spaced from the unit. The reflective surfaces also act to regulate or equalize the pattern of light when light sources of various arc tube lengths and/or envelope sizes are used in the lighting unit.

The first reflective surface extends circumferentially around the lateral internal surface of the reflector and the second reflective surface is defined by the bottom internal surface of the reflector. The first reflective surface on the lateral internal surface of the reflector is contoured to redirect or reflect the light rays striking it upward toward the surface above at specific angles measured from a vertical axis through the reflector. The second reflective surface along the bottom internal surface of the reflector is frustoconical and angled downward away from the light source to redirect or reflect the light rays striking it upward toward the surface above at specific angles measured from the vertical axis. The second reflective surface may have a central opening for illuminating objects below.

The lighting unit of the present invention further has baffle means for redirecting or reflecting both direct light rays from the light source and reflected light rays from the first and second reflective surfaces away from at least one spaced vertical surface in certain predetermined patterns. The means for redirecting or reflecting the direct and the reflected light rays are baffles for substantially reducing the amount of light radiating from the lighting unit toward a vertical surface. The baffles redirect or reflect such light away from the vertical surface. The baffles are disposed in a horizontal plane between the light source and the top of the lighting unit. A first set of baffles has a direct light cut-off and a reflected light cutoff baffle which are spaced in longitudinal parallel relationship. A second baffle is arranged in a V-shape. Both baffles have reflective surfaces angularly disposed to the vertical axis for redirecting or reflecting the light rays outward from the lighting unit in a predetermined pattern. The first set of baffles is arranged to cut-off both direct and reflected light rays from a nearby or adjacent vertical surface and redirect such light outward in a substantially 180° asymmetrical pattern so that the lighting unit can be placed adjacent a wall. The V-shaped baffle cuts off substantially 270° of both direct and reflected light rays toward at least one vertical surface and redirects or reflects such light outward away from the lighting unit in a substantially 90° asymmetrical pattern so that the lighting unit can be placed in a corner adjacent two walls.

It is an object of the present invention to provide a lighting unit or luminaire that will generate a controlled light pattern with high light output and efficiency.

Another object of the present invention is to regulate or equalize the pattern of light when light sources of various arc tube lengths and envelope sizes are used.

A further object of the present invention is to continue to provide substantially uniform intensity of light to an area to be illuminated when the lighting unit or luminaire is placed adjacent or near at least one vertical surface.

Other objects will appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a perspective view of the lighting unit of the present invention mounted on the top of a suitable stand.

FIG. 2 is a side elevational view of the lighting unit of the present invention.

FIG. 3 is a side elevational view of the reflector of the present invention.

DETAILED DESCRIPTION OF THE INVENTION

Figure 4:
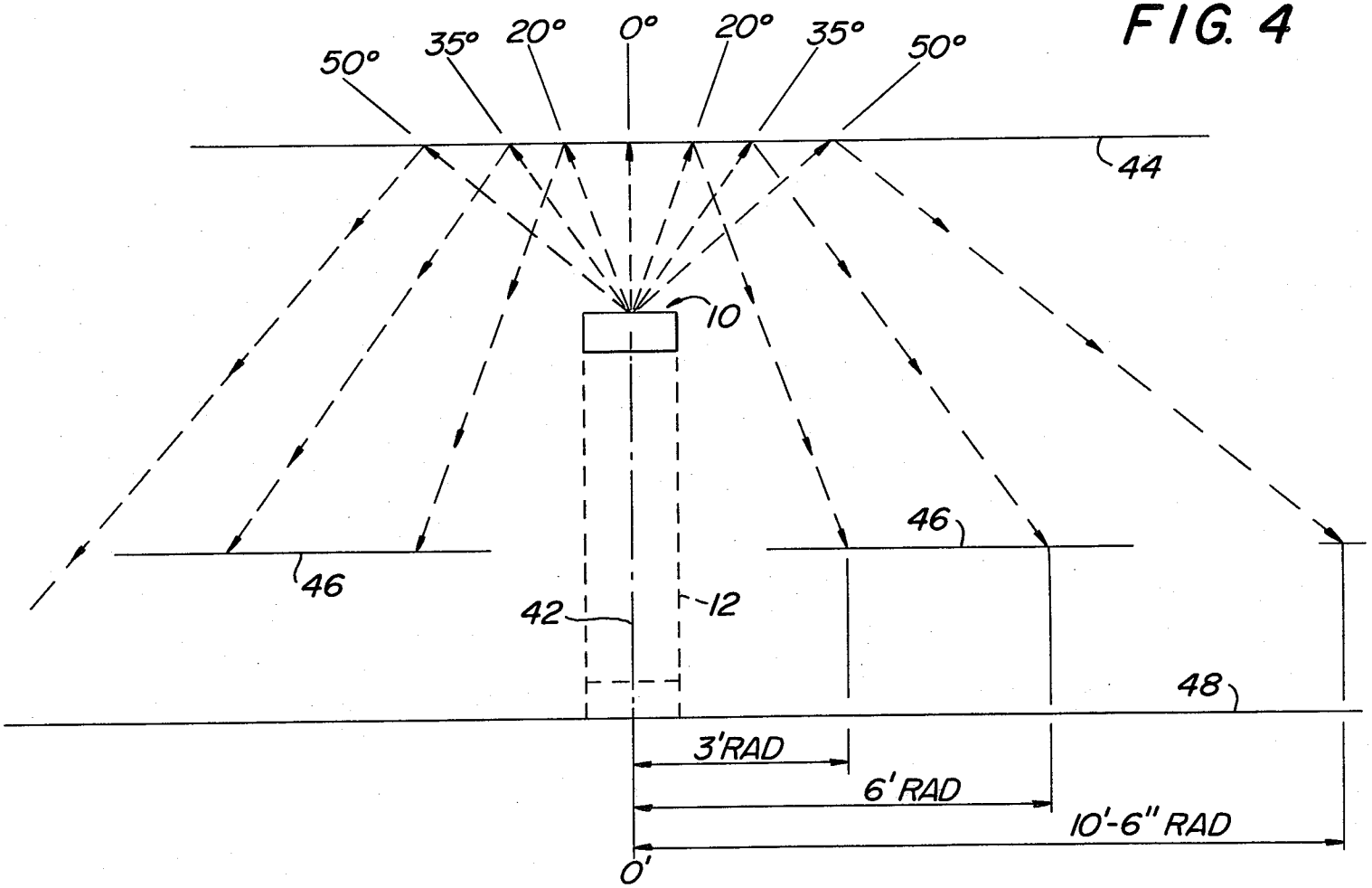
FIG. 4 is a schematic illustration, in elevation, of an arrangement for indirectly lighting an area in accordance with the present invention, specifically illustrating the striking and reflecting angles of the light rays on the surface above the lighting unit and the area to be illuminated.

The present invention is best understood by referring to the drawings wherein like numerals indicate like elements. Referring to FIG. 1, the lighting unit of the present invention, generally designated 10, can be mounted at the top of a stand 12. The stand 12 is sufficiently tall and balanced so as to support the lighting unit 10 at a height above eyelevel (usually 6 feet above the level of the floor) in order to avoid any direct light or glare from the lighting unit 10 to the work area. While the lighting unit 10 is preferably mounted on a stand, such as stand 12, in order to be placed at any location in a room, the lighting unit 10 is also mountable to vertical surfaces and walls within a room or suspendable from the ceiling.

Figure 12:
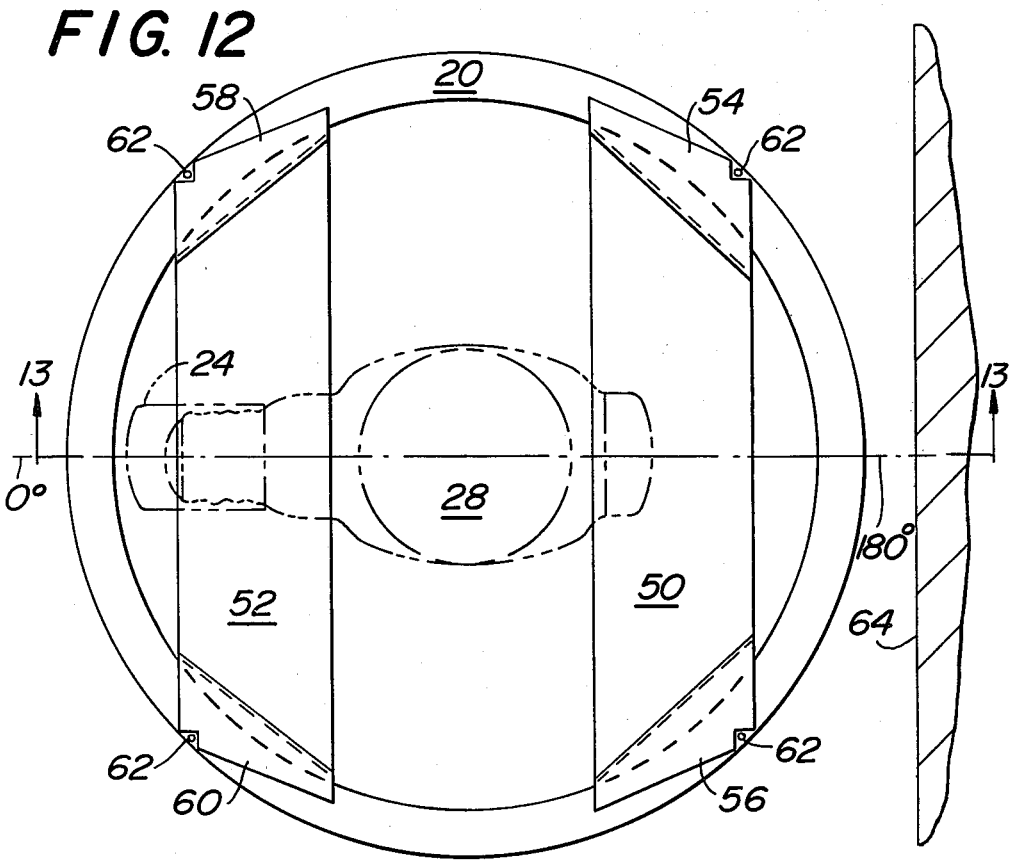
FIG. 12 is a top elevational view of the lighting unit of the present invention showing the arrangement of the 180° cut-off baffles installed on said lighting unit and also showing the 180° plane of the polar plot of FIG. 6.

Referring to FIG. 2, the lighting unit 10 comprises a bowl-shaped reflector 14 having a first reflective surface 16 and a second reflective surface 18. The reflector 14 has a flange 20 at its open end having four mounting holes 62 (FIG. 12) to secure the reflector 14 into a housing 22. The mounting holes 62, as shown in FIG. 12, are used in addition to securing the reflector 14 to the housing 22 for securing a flat glass lens and housing cover (not shown) to the housing 22.

The reflector 14 has a set of punched holes in its lateral wall which are used to mount and secure both the lamp socket 24 and the socket bracket 26 to the reflector 14. The bracket 26 supports the socket 24 so that the lamp 28 is disposed at the focal center of the reflector. The main light source, lamp 28, is preferably a high intensity discharge light source such as a metal halide or a high pressure sodium lamp. It should be noted that while the aforementioned type of lamp is preferred, other lamps can be used. The bracket 34 supports socket 32 for an optional stand-by quartz lamp 30. The bracket 34 is arranged to mount the stand-by lamp 30 below and along the same vertical plane as the main lamp 28. The stand-by lamp socket 32 and stand-by lamp socket bracket 34 are mounted to the main lamp socket bracket 26. All of the sockets and brackets are fastened to each other and to the reflector 14 using any means known per se in the mechanical arts, e.g., riveting, bolting, etc.

The stand-by lamp 30 is an auxiliary or emergency light source which operates when the main lamp 28 fails for any reason. A relay can be connected to the main lamp circuit for sensing momentary voltage interruptions which could extinguish the main lamp 28. If such a voltage interruption occurs, and the main lamp 28 is extinguished, the stand-by lamp 30 will be energized by the relay and provide sufficient light until the main lamp 28 cools and restrikes. As soon as the main lamp 28 restrikes, the sensing relay automatically de-energizes the stand-by lamp 30. Circuits, such as the one described immediately above, are well known in the electrical art and can be implemented using relay or integrated circuit devices.

The reflector 14 has an opening 36 at the center of its bottom portion. This opening, which is preferred to be 1.125 inches in diameter, serves as a downlight opening allowing sufficient light to project through the opening 36 through a lens 38 mounted across a similar opening in the bottom of the housing 22. The small quantity of light which passes through the opening 36 is used for accent lighting of objects, such as figurines and/or plants, placed at the bottom or on shelves of the stand 12.

It should be noted at this time that the reflector 14 must be modified in both dimensions, width or diameter and depth, to accommodate different sized lamps. A small reflector can house a 70–250 watt lamp. A medium reflector can house a 400 watt lamp. A large reflector can house a 1000 watt lamp. The dimensions of the reflector 14 increase as the lamp size and wattage increase. See Tables 1–3. Such related dimensional variations are described hereinafter.

As stated above, the reflector 14 has two reflective surfaces. The first reflective surface 16 extends along the lateral internal wall of the reflector 14. This surface 16 is a specular surface having, by way of example, an engraved chemical surface such as an Alzac anodized finish with a reflectance factor exceeding 83%. The reflective surface 16 is contoured so as to vary the radius of the reflector 14 with respect to its depth measurement. Each of the separately dimensioned reflectors for the differently sized lamps have contoured lateral internal surfaces as set forth in Tables 1–3. Specific dimensions of the reflector 14 are described in Tables 1, 2 and 3 for the several embodiments of the present invention; e.g., the 70–250 watt, the 400 watt and the 1000 watt reflectors, respectively. As shown in FIG. 3, contouring of the reflective surface 16 is divided into three areas; a frustoconical top portion A, a middle curved portion B, and a lower frustoconical portion C. The depth of each of the reflectors is denoted by D and the radius measurement by R. Other reference points that will be described more fully hereinafter are the focal center 40 of the reflector 14 and the vertical axis 42 through the focal center 40. See FIG. 3. The radius R is varied with respect to the depth of the reflector 14 in order to provide the desired contour to redirect or reflect the light rays striking it from the light source upward at the desired angles.

The second reflective surface 18 which is defined by the bottom internal surface of the reflector 14 is an engraved metal surface with a chemically brightened finish. This surface 18 is frustoconical and extends outward from the axis 42 at an angle of 9° away from the light source. The surface 18 is angled so as to reflect the light rays striking it upward toward the surface above at predetermined angles.

Preferably, the reflector 14 is a spun aluminum one-piece construction. The design of the reflector 14 renders the reflector fully symmetrical about the vertical axis 42. This allows the light generated from the lamp 28 to be utilized to its utmost. Further, the generated light is both controlled and shaped by the design of the reflector 14 to obtain the desired predetermined light pattern.

Figure 9:
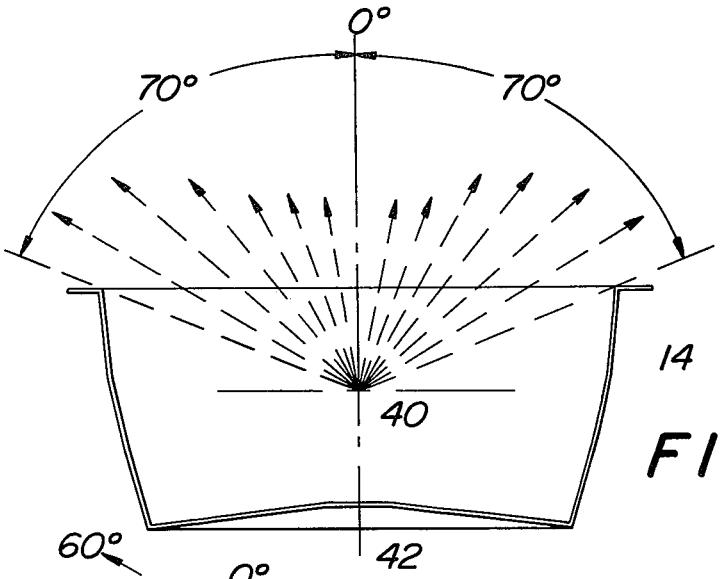
FIG. 9 is a schematic illustration of the direct light component of the lighting unit of the present invention.
Figure 10:
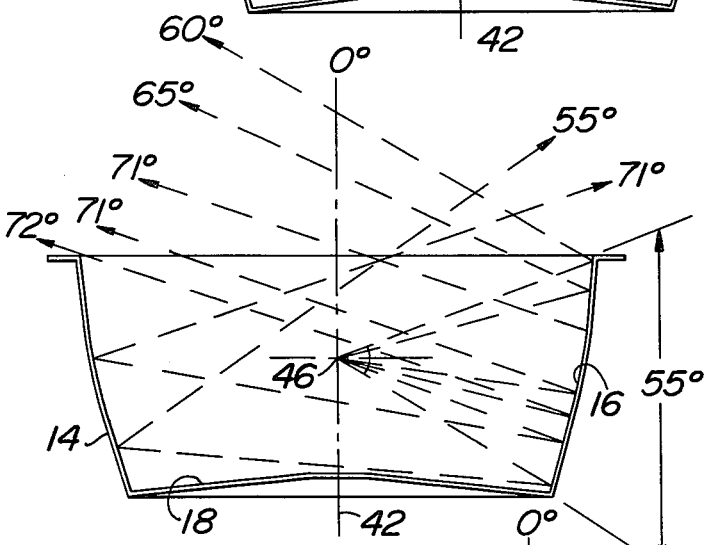
FIG. 10 is a schematic illustration of the contoured lateral reflective component of the reflector of the lighting unit of the present invention.
Figure 11:
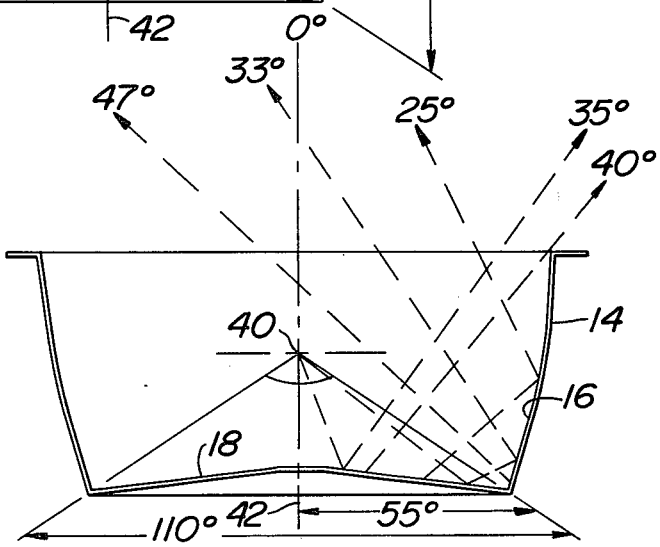
FIG. 11 is a schematic illustration of the bottom reflective light component of the reflector of the lighting unit of the present invention.

The light is generated and controlled by three functional components within the reflector 14. These are the direct light component, the lateral reflected light component and the bottom reflected light component. Referring to FIGS. 9, 10 and 11, each of these light components is shown respectively. For the ease of explanation of how each light component affects the cumulative total of light from each of the three components, the reflector focal center 40 will be used as the point from which all light rays emanate. The focal center 40 of the reflector 14 corresponds approximately with the center point of the lamp 28. Therefore, by passing a vertical plane through the focal center 40 of the reflector 14 the behavior of the light rays in that plane can be shown. The light rays comprising these three components in the single plane can be considered an approximation of all of the light rays which emanate from the lamp 28.

The direct light component, as shown in FIG. 9, is allowed to project upward through the upper opening of the reflector 14 through maximum angles of 70° as measured from the vertical axis 42 for a sum of 140°. The direct light component produces a highly efficient but relatively lower intensity light level on a surface above the lighting unit 10 such as a ceiling.

The lateral reflected light component, as shown in FIG. 10, is the combination of the redirected or reflected light rays striking the first reflective surface 16, which is projected upward through the opening in the reflector 14 toward the surface above the lighting unit 10. The reflected light rays are directed upward in angular planes between 55° and 72° as measured from the vertical axis 42. The lateral reflected light component accounts for 110° of the direct light rays from the lamp 28.

The bottom reflected light component, as shown in FIG. 11, is the light striking reflective surface 18 which redirects or reflects the light rays striking it emanating from the lamp 28 upward toward the surface above in angular planes between 25° and 47° as measured from the vertical axis 42. The bottom reflected light component encompasses 110° of direct light rays emanating from the lamp 28. The cumulative total from each of the three light components account for the full 360° of light emanating from the lamp 28 at the focal center 40.

Figure 7:
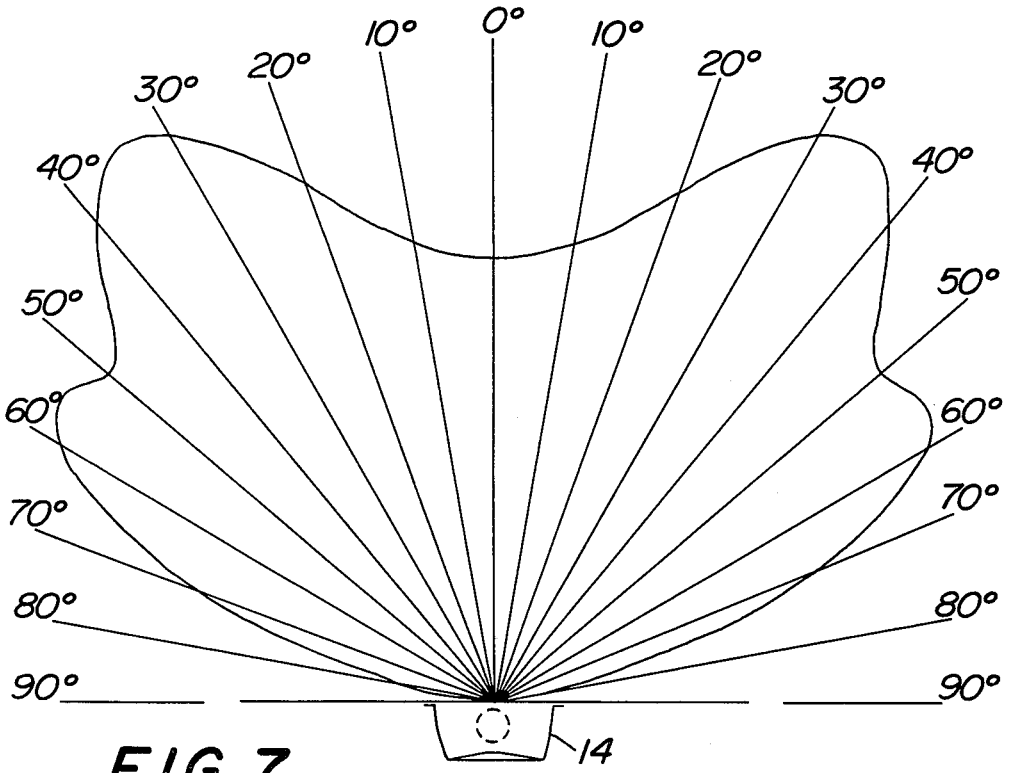
FIG. 7 is a polar plot showing the accumulative total lighting pattern resulting from the shape and contour of the reflector of the lighting unit of the present invention.

The illumination provided by both the direct and reflected light rays from each of the light components of the reflector 14 results in the desired predetermined lighting pattern. This lighting pattern as shown in FIG. 7 is plotted in polar form by measuring the intensity of the light in a common plane at various angles as measured from the vertical axis. The graphed line shows uniform intensity of light as measured from the vertex of the graph. From the graph of FIG. 7, it can be seen that the light has a peak or maximum candlepower at approximately 35° from the vertical axis. Further, the maximum candlepower zone is between 35° and 50° from the vertical axis. Almost no light occurs beyond 80° from the vertical axis and the light power between 65° and 80° drops off significantly. The space directly above the lamp 28 which corresponds with the angles of 15° on either side of the vertical axis has a light power significantly less than the maximum light power occuring 35°. This space between 15° on either side of the vertical axis would normally have a much higher intensity of light causing a "hot spot". Such condition does not exist with the lighting pattern of the present invention. Therefore, the lighting unit 10 of the present invention substantially eliminates "hot spots" from the direct and reflected light components of the lighting unit and provides for a more evenly balanced and uniform light intensity over the entire lighting pattern.

Referring now to FIG. 4, the lighting unit 10 is shown mounted in phantom on a stand 12 below a surface 44, such as a room ceiling. The light rays from the lighting unit 10 are directed upward in the lighting pattern described above in order to be reflected from the surface above 44 to a work area such as a desk or table top denoted generally at line 46 or the floor of the room 48. The work area 46 is approximately 30 inches above the floor 48. The predetermined symmetrical lighting pattern resulting from the specific construction of the reflector 14 of the lighting unit 10 provides for a substantially uniform light intensity to either or both the work area 46 and the floor 48 at least as far as a radius of 10.5 feet from the vertical axis 42 of the lighting unit 10. This is due to the physical effect of the light rays which strikes the ceiling 44 being reflected therefrom at the same angle at which the light ray strikes the ceiling. Therefore, the reflected light from the ceiling 44 will be uniformly directed across a broad pattern when reaching the work plane 46 or the floor 48. While the illustrated light rays shown in FIG. 4 stop at angles of 50° as measured from the vertical axis 42, light rays departing the lighting unit 10 at greater angles would strike the ceiling 44 and be reflected over an even broader area. The maximum light intensity to the work area will occur within a range of 6 to 10.5 feet from the lighting unit 10.

So far, the operation of the lighting unit 10 has been described as free-standing and generating a symmetrical lighting pattern over a 360° area. If the lighting unit 10 is placed near or adjacent to a vertical surface, such as a wall, or multiple vertical surfaces, such as a corner, the lighting unit 10 must be modified to eliminate bright spots and glare which will occur from the effect of the light being reflected from the vertical surfaces. The addition of baffle means in specific predetermined arrangements to the lighting unit 10 of the present invention will substantially eliminate the bright spots and/or glare from the vertical surfaces and, thus, provide a substantially uniform intensity of light over the desired area.

Figure 13:
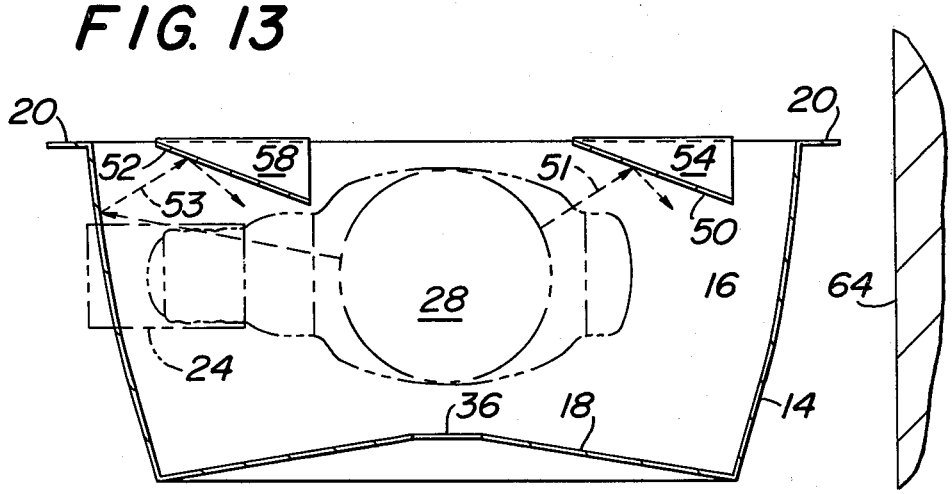
FIG. 13 is a side elevational view of the lighting unit of the present invention showing the 180° cut-off baffles installed on said lighting unit taken along line 13—13 of FIG. 12, and further schematically illustrating the redirection of both direct and reflected light rays from said lighting unit by the 180° cut-off baffles.

Referring now to FIGS. 12 and 13, a set of 180° cut-off baffles is placed across the top of the reflector 14 of the lighting unit 10 in order to cut-off both direct and reflected light toward the nearby vertical surface thus producing an asymmetric light pattern. This back light cut-off allows the lighting unit 10 to be placed against or near vertical surfaces because the bright light reflected from the vertical surface causing glare is reduced by 66% by the cut-off baffles. A set of the 180° cut-off baffles includes a direct light cutoff baffle 50 and a reflected light cut-off baffle 52. The direct light cut-off baffle 50 redirects or reflects the direct light rays 51 coming from the lamp 28. These light rays are reflected down toward the first and second reflective surfaces 16, 18 for reflection upward toward the surface above along defined angular planes. The reflected light cut-off baffle 52 redirects or reflects reflected light rays 53 from the first reflective surface 16 along the lateral internal surface of the reflector 14. These light rays are reflected down toward the second reflective surface 18 to be reflected again upward in defined angular planes. The baffles 50, 52 substantially cut-off and reflect both the direct and the reflected light rays before these light rays can strike the nearby or adjacent vertical surface 54 reducing bright spots and glare, thus, creating an asymmetric lighting pattern on the surface above.

Figure 5:
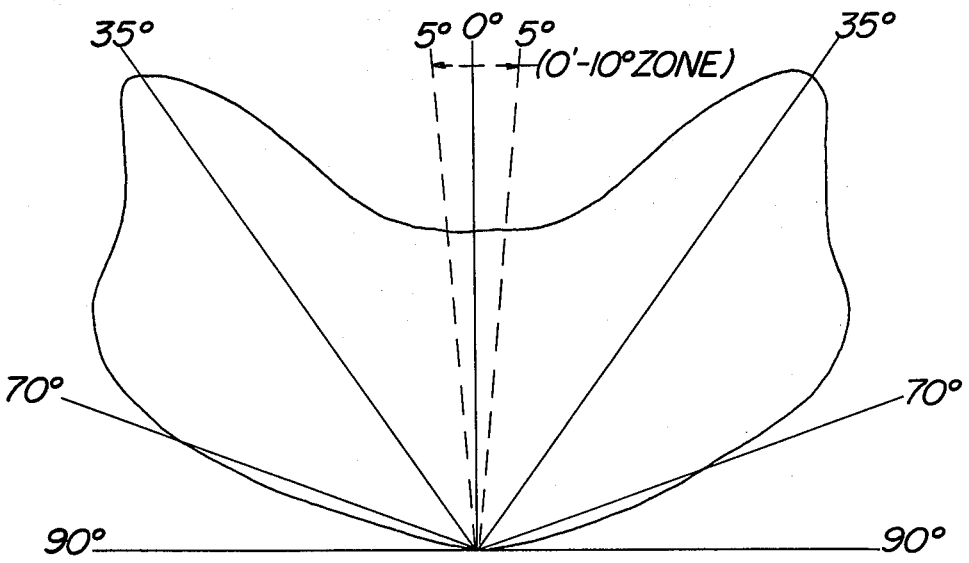
FIG. 5 is a polar plot in the 90° plane of a lighting unit of the present invention having a symmetric light pattern.
Figure 6:
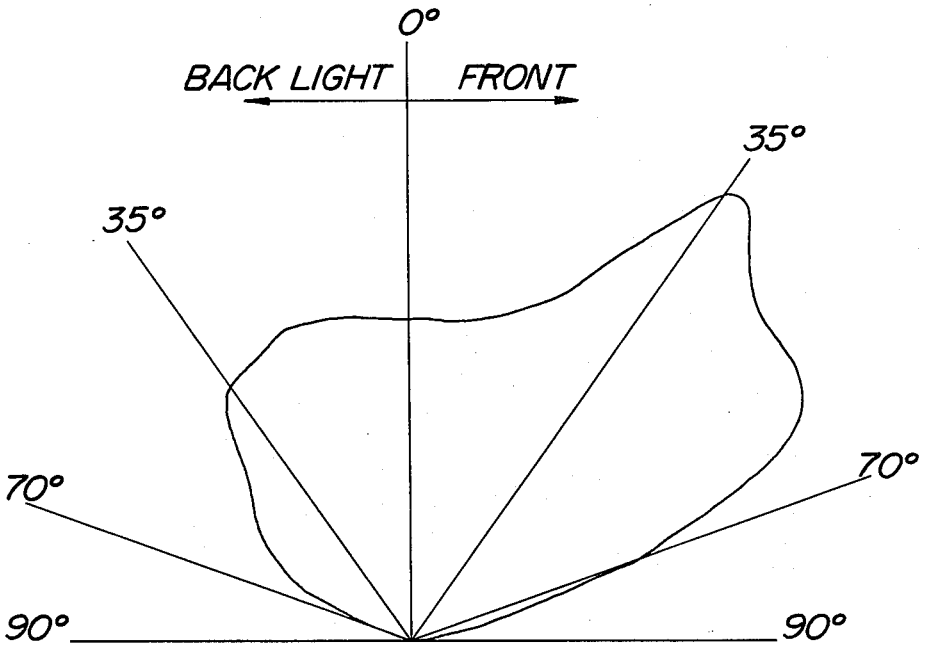
FIG. 6 is a polar plot along the 180° plane of the lighting unit of the present invention showing the asymetric light pattern resulting from the use of 180° cut-off baffles with the lighting unit of the present invention.

The polar plot of FIG. 6 shows the asymmetric light pattern caused by the addition of the baffles 50, 52 to the lighting unit 10. The polar plot is shown on the vertical plane along the axis 0°–180° which passes through the focal center of the reflector 14. Note the retained similarity of the front light pattern in FIG. 6 to that of the 90° light patterns in FIGS. 5 and 7.

The baffles 50, 52 can be installed in any horizontal plane spaced between the lamp 28 and the top of the reflector 14. The two baffles 50, 52 are preferably disposed in longitudinal parallel spaced relationship across the opening at the top of the reflector 14. Both baffles 50, 52 have reflective flat surfaces angled downward at an angle of 20° away from the horizontal plane in which they are mounted. The baffles 50, 52 are made of metal, preferably 20 gauge steel, having a high temperature white paint finish. The direct light cut-off baffle 50 has two side members which support it in its angular relationship and provide for the mounting of the baffle 50 along the flange 20 of the reflector 14. The reflected light cut-off baffle 52 has two side members 58, 60 for holding the baffle in its angular relationship and provides for mounting the baffle 52 to the flange 20. Each of the side members 54-60 of the baffles 50, 52 have a notched corner in order that, when mounted between the flange 20 and the housing cover, the side members 54-60 register against the screws 62 which hold the reflector 14 in place. It should be noted that the side members 54-60 can be modified to accommodate the baffles 50, 52 in both the same angular and parallel spaced relationships and enable the baffles 50, 52 to be mounted in any single horizontal plane between the lamp 28 and the top of the reflector 14.

Figure 14:
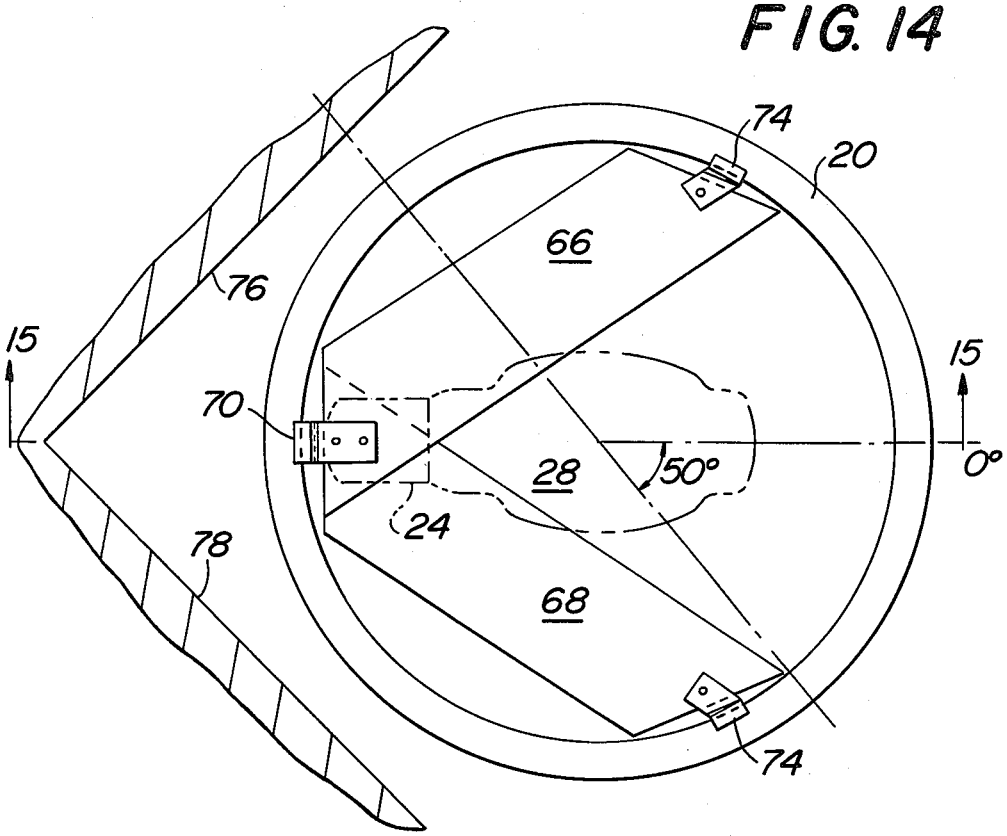
FIG. 14 is a top elevational view of the lighting unit of the present invention showing the 270° cut-off baffles mounted on said lighting unit and also showing the 50° plane of the polar plot of FIG. 8.
Figure 15:
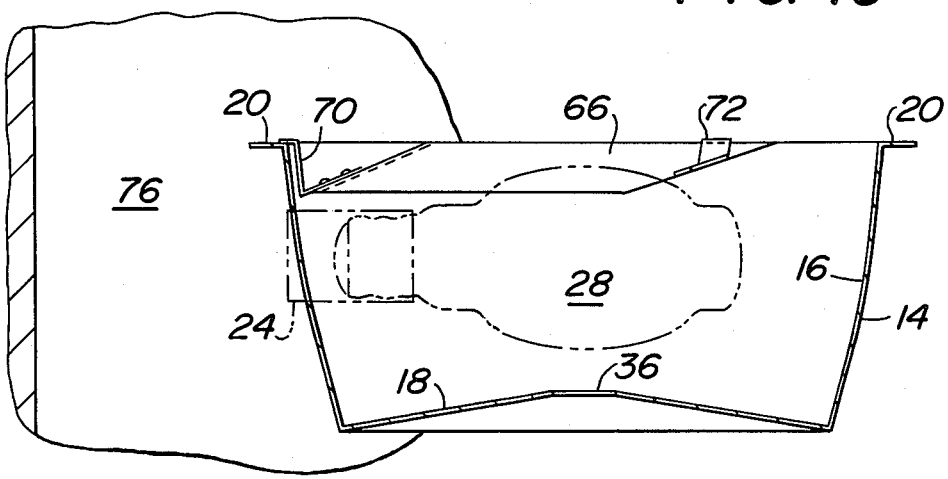
FIG. 15 is a side elevational view of the lighting unit of the present invention showing the 270° cut-off baffles installed on said lighting unit taken along line 15—15 of FIG. 14.

When the lighting unit 10 is used at or near the corner of a room or any other adjacent vertical surfaces, a 270° cut-off baffle is added to the reflector 14 to reduce the backlight by approximately 50% from both adjoining walls. Referring to FIGS. 14 and 15, the 270° cut-off baffle is V-shaped with two reflective leg members 66, 68. Each leg member 66, 68 is made of metal, preferably 20 gauge steel, and has a high temperature white paint finish. The leg members 66, 68 are generally trapezoidal in shape and joined by overlapping their opposing ends to form the V-shape with their longitudinal axes having an angle of approximately 65° at the vertex. The overlapped ends are bent downward at an angle corresponding to the angular relationship of the leg members 66, 68 to the horizontal plane of the top of the reflector 14. The two leg members 66, 68 are joined in the overlapped area in any known mechanical fashion, e.g., rivets, screws, bolts, etc., to a tab 70. The tab 70 is bent in a Z-shape with the lower portion attached to the overlapped area of the two leg members 66, 68 and the upper portion overlying the flange 20. This arrangement allows the upper edge of the angularly disposed leg members 66, 68 of the V-shaped baffle to lie in the preferred horizontal plane across the top of the reflector 14. Tabs 72, 74 are attached by similar mechanical fasteners to leg members 66, 68 respectively. The tabs 72, 74 are configured so as to hold the leg members 66, 68 angled downward at an angle of 20° away from the preferred horizontal plane described above by resting on the flange 20 of the reflector 14.

The V-shaped baffle considerably reduces both the direct and reflected light rays emanating from the lighting unit 10 from striking the nearby or adjacent vertical surfaces 76, 78 such as the walls of a room at a corner thereof. This reduction in the backlight eliminates brightspots and glare on the walls 76, 78 and creates an asymmetric lighting pattern on the surface above. This pattern is shown in the polar plot of FIG. 8 which is taken along the 50° plane of the reflector 14 of FIG. 14. Note that the front light pattern in FIG. 8 retains a simlarity to the 90° light pattern in FIGS. 5 and 7. The vertex lower portion of the V-shaped baffle should always point towards the corner of the walls when properly installed in order to obtain the greatest reduction in the light intensity of the backlight from the adjacent walls.

Both the 180° cut-off baffles and the 270° cut-off baffles can be included with the lighting unit 10 or added to it if the lighting unit is to be moved to either a wall or a corner. The modification to the lighting unit would be made in accordance with the above description.

For example, if the 180° cut-off baffles are placed on the 250 W reflector of the present invention, the direct light cut-off baffle 50 which has a trapezoidal shape is $10\frac{5}{8}$ inches and 6 inches long respectively on its parallel sides and $2\frac{7}{8}$ inches wide. The reflective light cut-off baffle 52 which also has a trapezoidal shape is 10½ inches and 6 9/16 inches long, respectively on its parallel sides and 2¾ inches wide. The two baffles 50, 52 should be spaced approximately 2⅝ inches apart and ⅝ inches from the side of the reflector 14 at their midpoints to achieve the lighting effect described above. If the 270° cut-off baffle is placed on the 250 W reflector both leg members 66, 68 which are trapezoidally shaped, would be 11 inches and 7 17/64 inches long respectively on their parallel sides and 2⅞ inches wide. The 270° cut-off baffle should be spaced approximately ¼ inches from a point along the side of the reflector 14 opposite the closest point of the symmetrical axis extending through the vertex of the V-shaped 270° cut-off baffle. The opposite ends of the leg members 66, 68 extend outward to touch the sides of the reflector 14 at points in conformity with the internal angular spacing and the lengths of the leg members 66, 68. This dimensioning and placement of the 270° cut-off baffle will provide the lighting effect described above. Both baffles when used with the differently sized reflector, e.g. 400 W and 1000 W, will have dimensions which will vary proportionately to the size and dimensions of the reflector.

Figure 8:
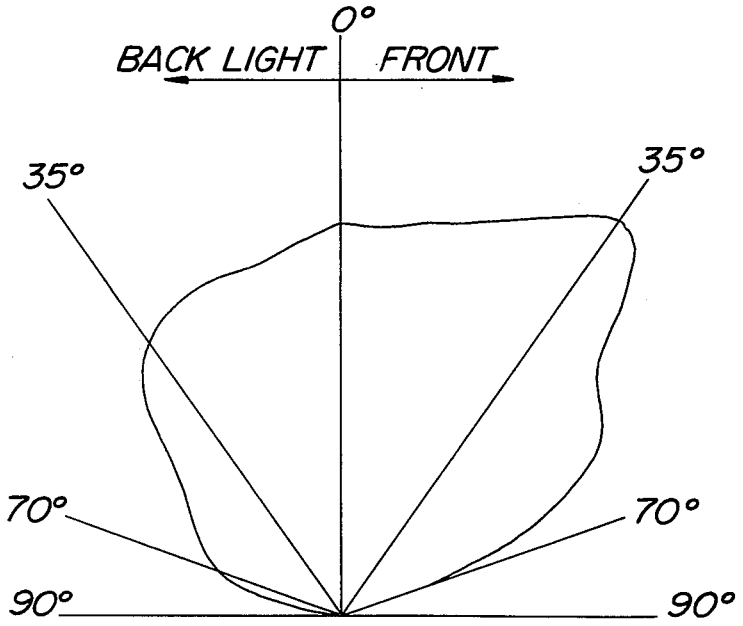
FIG. 8 is a polar plot across the 50° plane of the lighting unit of the present invention showing the asymetric light pattern of the 270° cut-off baffles of the lighting unit of the present invention.

It can be readily seen by comparing FIGS. 5, 6 and 8 that the cut-off baffles effectively reduce the reflected light from nearby or adjacent vertical surfaces. FIG. 5 is the polar plot of the lighting unit 10 without any cut-off baffles wherein the lighting unit produces a symmetric light pattern for reflection from the surface above. In comparing that pattern to the patterns in FIG. 6, which is the polar plot of the lighting unit 10 with the 180° cut-off baffles added, and FIG. 8, which is the polar plot of the lighting unit 10 with the 270° cut-off baffles added, the effect of the baffles in reducing the backlight such as bright spots, etc. from nearby or adjacent vertical surfaces or walls is quite apparent.

The data used to derive the polar plots of FIGS. 5, 6 and 8 was obtained from test data using a 175 watt metal halide lamp in the reflector 14 in the three lighting unit arrangements described above, i.e., without baffles, with a 180° cut-off baffle, and with a 270° cut-off baffle.

The lighting unit of the present invention, more specifically the construction of the reflector, provides for the controlled lighting patterns for high light output. The lighting unit makes provision for the elimination of bright spots both directly above and on adjacent or nearby vertical surfaces, thus eliminating unwanted glare and nonuniform light intensity of the work area. It is now, therefore, possible to place the lighting unit of the present invention in any desired position within a room or other area and obtain a lighting pattern of substantially uniform light intensity directed toward the work area.

The present invention may be embodied in other specific forms without departing from the spirit or essential attributes thereof and, accordingly, reference should be made to the appended claims, rather than to the foregoing specification, as indicating the scope of the invention.

TABLE 1

| 70–250 W Lateral Internal Reflective Wall 16: | |
|---|---|
| depth from top of reflector (inches) | radius from vertical axis (inches) |
| 0.000 | 5.875 |
| 0.250 | \| |

TABLE 1-continued

| 70–250 W Lateral Internal Reflective Wall 16: | |
|---|---|
| depth from top of reflector (inches) | radius from vertical axis (inches) |
| 0.500 | conical |
| 0.750 | \| |
| 1.000 | \| |
| 1.250 | 5.755 |
| 1.500 | 5.725 |
| 1.750 | 5.703 |
| 2.000 | 5.671 |
| 2.250 | 5.625 |
| 2.500 | 5.585 |
| 2.750 | 5.538 |
| 3.000 | 5.484 |
| 3.250 | 5.421 |
| 3.500 | \| |
| 3.750 | \| |
| 4.000 | \| |
| 4.250 | conical |
| 4.500 | \| |
| 4.750 | \| |
| 5.000 | \| |
| 5.250 | \| |
| 5.500 | 4.812 |
| Bottom Internal Reflective Surface 18: 9° conical; radius 4.812 inches | |

TABLE 2

| 400 W Lateral Internal Reflective Wall 16: | |
|---|---|
| depth from top of reflector (inches) | radius from vertical axis (inches) |
| 0.000 | 7.375 |
| 0.250 | \| |
| 0.500 | \| |
| 0.750 | conical |
| 1.000 | \| |
| 1.250 | \| |
| 1.500 | 7.241 |
| 1.750 | 7.210 |
| 2.000 | 7.188 |
| 2.250 | 7.156 |
| 2.500 | 7.125 |
| 2.750 | 7.086 |
| 3.000 | 7.053 |
| 3.250 | 7.015 |
| 3.500 | 6.963 |
| 3.750 | 6.906 |
| 4.000 | 6.843 |
| 4.250 | \| |
| 4.500 | \| |
| 4.750 | \| |
| 5.000 | \| |
| 5.250 | \| |
| 5.500 | conical |
| 5.750 | \| |
| 6.000 | \| |
| 6.250 | \| |
| 6.500 | \| |
| 6.750 | \| |
| 6.921 | 6.000 |
| Bottom Internal Reflective Surface 18: 9° conical; radius 6.000 inches | |

TABLE 3

| 1000 W Lateral Internal Reflective Wall 16: | | | |
|---|---|---|---|
| depth from top of reflector (inches) | radius from vertical axis (inches) | depth from top of reflector (inches) | radius from vertical axis (inches) |
| 0.000 | 9.656 | 5.750 | 8.968 |
| 0.250 | \| | 6.000 | 8.921 |
| 0.500 | \| | 6.250 | 8.857 |
| 0.750 | \| | 6.500 | \| |

TABLE 3-continued

| 1000 W Lateral Internal Reflective Wall 16: | | | |
|---|---|---|---|
| depth from top of reflector (inches) | radius from vertical axis (inches) | depth from top of reflector (inches) | radius from vertical axis (inches) |
| 1.000 | \| | 6.750 | \| |
| 1.250 | \| | 7.000 | \| |
| 1.500 | conical | 7.250 | \| |
| 1.750 | \| | 7.500 | \| |
| 2.000 | \| | 7.750 | \| |
| 2.250 | \| | 8.000 | \| |
| 2.500 | \| | 8.250 | \| |
| 2.750 | \| | 8.500 | \| |
| 3.000 | \| | 8.750 | conical |
| 3.250 | 9.375 | 9.000 | \| |
| 3.500 | 9.335 | 9.250 | \| |
| 3.750 | 9.296 | 9.500 | \| |
| 4.000 | 9.270 | 9.750 | \| |
| 4.250 | 9.234 | 9.000 | \| |
| 4.500 | 9.203 | 9.250 | \| |
| 4.750 | 9.156 | 9.500 | \| |
| 5.000 | 9.114 | 9.750 | \| |
| 5.250 | 9.063 | 10.000 | \| |
| 5.500 | 9.015 | 10.188 | 7.843 |
| Bottom Internal Reflective Surface 18: 9° conical; radius 7.843 inches | | | |

I claim:

1. A lighting unit for indirect illumination of a surface comprising a bowl-shaped symmetrical reflector, said reflector including first and second reflective surfaces contoured to direct generally upward, in a predetermined pattern, light rays emanating from a light source centrally disposed within said reflector, said first reflective surface being the lateral circumferential internal wall of said reflector and said second reflective surface being the lower wall of said reflector, said first reflective surface comprising an upper frustoconical portion, a lower frustoconical portion and an arcuate portion disposed intermediate the upper and lower portions, said second reflective surface being a convex frustoconical surface whereby the reflective surfaces generally direct the reflected light rays away from a vertical axis extending through the central axis of the lighting unit at predetermined angles for reflection by a surface spaced above the lighting unit to provide for substantially uniform intensity of light to the surface to be illuminated.

2. A lighting unit according to claim 1 wherein the second reflective surface extends frustoconically outward from a central axis at an angle of 9° for reflecting the light rays striking it upward toward the surface above at angles between 25° and 47° as measured from the vertical axis.

3. A lighting unit according to claim 2 wherein the first reflective surface reflects the light rays striking it upward toward the surface above at angles between 55° and 72° as measured from the vertical axis, said first reflective surface being contoured to reflect the light rays between the above-mentioned angles by varying the radius with respect to the depth of the reflector as set forth in the table below:

| depth (inches) | radius (inches) |
|---|---|
| 0.000 | 5.875 |
| 0.250 | \| |
| 0.500 | conical |
| 0.750 | \| |
| 1.000 | \| |
| 1.250 | \| |

-continued

| depth (inches) | radius (inches) |
|---|---|
| 1.500 | 5.725 |
| 1.750 | 5.703 |
| 2.000 | 5.671 |
| 2.250 | 5.625 |
| 2.500 | 5.585 |
| 2.750 | 5.538 |
| 3.000 | 5.484 |
| 3.250 | 5.421 |
| 3.500 | \| |
| 3.750 | \| |
| 4.000 | \| |
| 4.250 | \| |
| 4.500 | conical |
| 4.750 | \| |
| 5.000 | \| |
| 5.250 | \| |
| 5.500 | 4.812 |

4. A lighting unit according to claim 2 wherein the first reflective surface reflects the light rays striking it upward toward the surface above at angles between 55° and 72° as measured from the vertical axis, said first reflective surface being contoured so as to reflect the light rays between the above-mentioned angles by varying the radius with respect to the depth of the reflector as set forth in the table below:

| depth (inches) | radius (inches) |
|---|---|
| 0.000 | 7.375 |
| 0.250 | \| |
| 0.500 | \| |
| 0.750 | conical |
| 1.006 | \| |
| 1.250 | \| |
| 1.500 | 7.241 |
| 1.750 | 7.210 |
| 2.000 | 7.188 |
| 2.250 | 7.156 |
| 2.500 | 7.125 |
| 2.750 | 7.086 |
| 3.000 | 7.053 |
| 3.250 | 7.015 |
| 3.500 | 6.963 |
| 3.750 | 6.906 |
| 4.000 | 6.843 |
| 4.250 | \| |
| 4.500 | \| |
| 4.750 | \| |
| 5.000 | \| |
| 5.250 | \| |
| 5.500 | conical |
| 5.750 | \| |
| 6.000 | \| |
| 6.250 | \| |
| 6.500 | \| |
| 6.750 | \| |
| 6.921 | 6.000 |

5. A lighting unit according to claim 2 wherein the first reflective surface reflects the light rays striking it upward toward the surface above at angles between 55° and 72° as measured from the vertical axis, said first reflective surface being contoured so as to reflect the light rays between the above-mentioned angles by varying the radius with respect to the depth of the reflector as set forth in the table below:

| depth (inches) | radius (inches) |
|---|---|
| 0.000 | 9.656 |
| 0.250 | \| |
| 0.500 | \| |
| 0.750 | \| |

-continued

| depth (inches) | radius (inches) |
|---|---|
| 1.000 | \| |
| 1.250 | \| |
| 1.500 | \| |
| 1.750 | conical |
| 2.000 | \| |
| 2.250 | \| |
| 2.500 | \| |
| 2.750 | \| |
| 3.000 | \| |
| 3.250 | 9.375 |
| 3.500 | 9.335 |
| 3.750 | 9.296 |
| 4.000 | 9.270 |
| 4.250 | 9.234 |
| 4.500 | 9.203 |
| 4.750 | 9.156 |
| 5.000 | 9.114 |
| 5.250 | 9.063 |
| 5.500 | 9.015 |
| 5.750 | 8.968 |
| 6.000 | 8.921 |
| 6.250 | 8.857 |
| 6.500 | \| |
| 6.750 | \| |
| 7.000 | \| |
| 7.250 | \| |
| 7.500 | conical |
| 7.750 | \| |
| 8.000 | \| |
| 8.250 | \| |
| 8.500 | \| |
| 8.750 | \| |
| 9.000 | \| |
| 9.250 | conical |
| 9.500 | \| |
| 9.750 | \| |
| 10.000 | \| |
| 10.188 | 7.843 |

6. A lighting unit according to claim 1 further comprising baffle means for redirecting both direct light rays from a light source and reflected light rays from the first and second reflective surfaces away from at least one spaced apart vertical surface in predetermined patterns.

7. A lighting unit according to claim 6 wherein the means for reflecting the direct and the reflected light rays is a set of reflecting baffles disposed in a horizontal plane spaced between a light source and the top of the lighting unit whereby the set of baffles substantially reduces the amount of light radiating from the lighting unit toward at least one spaced apart vertical surface and redirects such light away from said surface in a substantially 180° asymmetric pattern.

8. A lighting unit according to claim 7 wherein the set of baffles comprises a direct light cut-off baffle and a reflected light cut-off baffle in longitudinal parallel spaced relationship, said baffles being reflective and having side members for mounting to the lighting unit so that each baffle is angled downward with respect to the horizontal plane with the upwardly facing edges of the baffles disposed in said horizontal plane whereby both direct and reflected light rays are redirected outward in the direction of the upwardly facing edges of the baffles.

9. A lighting unit acoding to claim 6 wherein the baffle means for redirecting the direct and the reflected light rays is a V-shaped baffle disposed between the light source and the top of the lighting unit whereby the V-shaped baffle substantially reduces the amount of light radiating from the lighting unit toward spaced apart vertical surfaces defining a corner and redirects or reflects such light away from said surfaces in a substantially asymmetric pattern.

10. A lighting unit according to claim 9 wherein the V-shaped baffle comprises two reflective leg members joined at opposing ends so that the leg members are in an angular relationship with respect to each other and to the horizontal plane with the internal edges of the leg members disposed above and inwardly of the external edges of the leg members whereby both direct and reflected light rays are redirected outward from the notch of the V-shaped baffle.

* * * * *